US005751302A

United States Patent [19]

Rezanka

[11] Patent Number: 5,751,302

[45] Date of Patent: May 12, 1998

[54] TRANSDUCER POWER DISSIPATION CONTROL IN A THERMAL INK JET PRINTHEAD

[75] Inventor: Ivan Rezanka, Pittsford, N.Y.

[73] Assignee: Xerox Corporation, Stamford, Conn.

[21] Appl. No.: 624,158

[22] Filed: Mar. 29, 1996

[51] Int. Cl.[6] ..... B41J 29/38; B41J 2/05

[52] U.S. Cl. ..... 347/9; 347/14; 347/57

[58] Field of Search ..... 347/9, 14, 57; 346/1.1, 140, 140 R, 74 PH

[56] References Cited

U.S. PATENT DOCUMENTS

| | | | |
|---|---|---|---|
| 5,036,337 | 7/1991 | Rezanka | 346/1.1 |
| 5,049,898 | 9/1991 | Arthur et al. | 346/1.1 |
| 5,107,276 | 4/1992 | Kneezel et al. | 346/1.1 |
| 5,223,853 | 6/1993 | Wysocki et al. | 346/1.1 |
| 5,300,968 | 4/1994 | Hawkins | 346/140 |
| 5,422,664 | 6/1995 | Stephany | 347/14 |
| 5,483,265 | 1/1996 | Kneezel et al. | 347/14 |

FOREIGN PATENT DOCUMENTS

| | | | |
|---|---|---|---|
| 90/10540 | 9/1990 | WIPO | 346/140 R |

*Primary Examiner*—Peter S. Wong
*Assistant Examiner*—Rajnikant B. Patel
*Attorney, Agent, or Firm*—Daniel J. Krieger

[57] ABSTRACT

A method of controlling the operation of an ink jet printhead having a burn voltage applied to a transducer nucleating an ink bubble to cause an ink droplet to be ejected from an ink ejecting orifice. The method includes determining a threshold power dissipated by the transducer sufficient to cause the bubble to nucleate, the threshold power being determined by a firing pulse having a pulse length and a threshold voltage, selecting the pulse length of the firing pulse to be approximately equal to a pulse length necessary to achieve the highest effective power dissipation in the transducer, and selecting the burn voltage as a function of the threshold voltage. Changes to the threshold power dissipated by the transducer necessary to eject from the ink ejecting orifice are determined and the pulse length of the firing pulse is adjusted accordingly.

13 Claims, 5 Drawing Sheets

TRANSDUCER POWER DISSIPATION CONTROL IN A THERMAL INK JET PRINTHEAD

FIELD OF THE INVENTION

This invention relates generally to ink jet printers and more particularly to thermal ink jet printheads having power dissipation control compensating for changing operating conditions over time.

BACKGROUND OF THE INVENTION

Liquid ink printers of the type frequently referred to as continuous stream or as drop-on-demand, such as piezoelectric, acoustic, phase change wax-based, or thermal, have at least one printhead from which droplets of ink are directed towards a recording sheet. Within the printhead, the ink is contained in a plurality of channels each being terminated by an ink ejecting orifice or nozzle. Power pulses received by thermal transducers or piezoelectric transducers cause the droplets of ink to be expelled as required from the nozzles. Continuous ink stream printers are also known.

The printhead may be incorporated into either a carriage-type printer or a page-width type printer. The carriage-type printer typically has a relatively small printhead containing the ink channels and nozzles. The printhead can be sealingly attached to a disposable ink supply cartridge and the combined printhead and cartridge assembly is attached to a carriage which is reciprocated to print one swath of information (equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith. The procedure is repeated until the entire page is printed. In contrast, the page-width printer includes a stationary printhead having a length sufficient to print across the width or length of a sheet of recording medium. The paper is continually moved past the page-width printhead in a direction substantially normal to the printhead length and at a constant or varying speed during the printing process. A page-width ink-jet printer is described, for instance, in U.S. Pat. No. 5,192,959.

One known method of fabricating a thermal ink jet printheads is to form a plurality of the ink flow directing components, including the channels, and a plurality of logic, driver, and thermal transducer components on respective silicon wafers. The wafers are aligned and bonded together, followed by a process for separating the wafers into a plurality of individual printheads, such as by dicing. The individual printheads are used either individually in the scanning type of printer or are butted together or staggered, placed on a supporting substrate, aligned, and permanently fixed in position to form a large array printhead or a page width array printhead for the page-width printer.

In a thermal ink-jet printhead, the heat energy is produced by a thermal transducer component, such as a resistor, located in a respective one of the channels, which is individually addressable to nucleate an ink bubble within the ink located in the channels. As voltage is applied across a selected resistor a vapor bubble is nucleated within the ink thereby causing the ink to bulge from the channel orifice. The voltage is applied past the point of nucleation and is then removed. The bubble first expands and then collapses. The collapsing bubble causes some of the ink to retract back into the channel which in turn separates from the bulging ink which is expelled as an ink droplet in a direction away from the nozzle and towards the recording medium. Upon hitting the recording medium, a spot or mark is formed. The channel is then refilled by capillary action, which, in turn, draws ink from a supply container of liquid ink. Operation of a thermal ink-jet printer is described in, for example, U.S. Pat. No. 4,849,774.

A variety of operating conditions affect the generation of a robust and stable ink droplets and the ejection thereof from the nozzles of an ink jet printhead. For instance, a voltage drop on the power supply circuitry supplying the voltage to the transducers can vary from transducer to transducer depending on how many of the transducers are being energized at a time. In addition, the voltage drop for transducers in the middle of an array of transducers may be different than the voltage drop for transducers located at the ends of an array of transducers.

The heat energy developed by each of the transducers can also vary due to manufacturing variability of resistivity and size. Likewise, the energy delivered to the ink and used to propel drops can vary with time as the transducer is aging. One such phenomenon is known as kogation. Kogation is a buildup of deposits resulting from the ink and deposited on the thermal transducer which occur due to heating of the ink in contact with the thermal transducer. The deposits form over time and cause the thermal transducer to be less effective in transferring heat to the ink.

Various methods and apparatus for controlling the generation of ink droplets in an ink jet printer are illustrated and described in the following disclosures which may be relevant to certain aspects of the present invention.

In U.S. Pat. No. 5,036,337 to Rezanka, a method and apparatus for controlling the volume of ink droplets ejected from a thermal ink jet printhead is described. Electrical signals applied to heating elements for generating droplet ejecting bubbles thereon are composed of packets of electrical pulses. The number of pulses per packet and the width of the pulses within a packet and the spacing therebetween are controlled in accordance with manufacturing tolerance variations, the locations of addressed heating elements in the printhead, the number of parallel heating elements concurrently energized, and the temperature of the printhead in the vicinity of the heating elements to maintain the desired volume of the ejected droplets.

U.S. Pat. No. 5,223,853 to Wysocki et al., describes a system control for an ink jet printing apparatus for propelling ink jet droplets on demand from a printhead. The temperature of the ink in the printhead is sensed, and a combination of power level and time duration of the electrical input signal for heating elements, resulting in a desired size of the mark on the copy sheet, is selected by entering the sensed temperature of the ink into a predetermined function relating the energy of the electrical input signal to the corresponding resulting size of the mark on the copy sheet.

U.S. Pat. No. 5,300,968 to Hawkins describes an apparatus for stabilizing thermal ink jet printer spot size. A controller has a power supply means and a delay means that vary the amplitude and the duration of the input signals necessary to energize heater elements for producing drop ejection in relation to the printhead temperature.

U.S. Pat. No. 5,422,664 to Stephany describes a method and apparatus for maintaining constant drop size mass in thermal ink jet printers. The mass of ink droplets ejected from printhead nozzles under the control of electrical pulses is measured by a resident vibratory device. A piezoelectric sensor, such as a quartz crystal, serves as an environment for measuring the mass of the ink droplets deposited on the crystal face thereof. The difference in frequency before and after drop deposition is proportional to the ink drop mass. Frequency change is measured to provide a feedback signal to the printer controller for adjustment of the droplet ejecting pulses to control the drop size.

U.S. Pat. No. 5,483,265 to Kneezel et al. describes a thermal ink jet printhead which is controlled to minimize missing droplets at elevated operating temperatures by varying the voltage and pulse width applied to the heater element that causes droplets to be formed and ejected. At increased operating temperatures, smaller droplets minimize the introduction of air into the nozzles of the printhead upon ejection. Minimizing the introduction of air eliminates printhead misfirings and causes more consistent jetting of the ink droplets.

SUMMARY OF THE INVENTION

In accordance with one aspect of the present invention, there is provided a method of controlling the operation of an ink jet printhead including a transducer dissipating power in response to an electrical operating pulse applied thereto for nucleating an ink bubble to cause an ink droplet to be ejected from an ink ejecting orifice. The method includes the steps of selecting a burn voltage of the electrical pulse, selecting a nominal pulse length as a function of the selected burn voltage, determining a threshold voltage of the electrical pulse having the selected nominal pulse length sufficient to cause the ink bubble to nucleate, and selecting an operating pulse length for the operating pulse as a function of the determined threshold voltage.

BRIEF DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
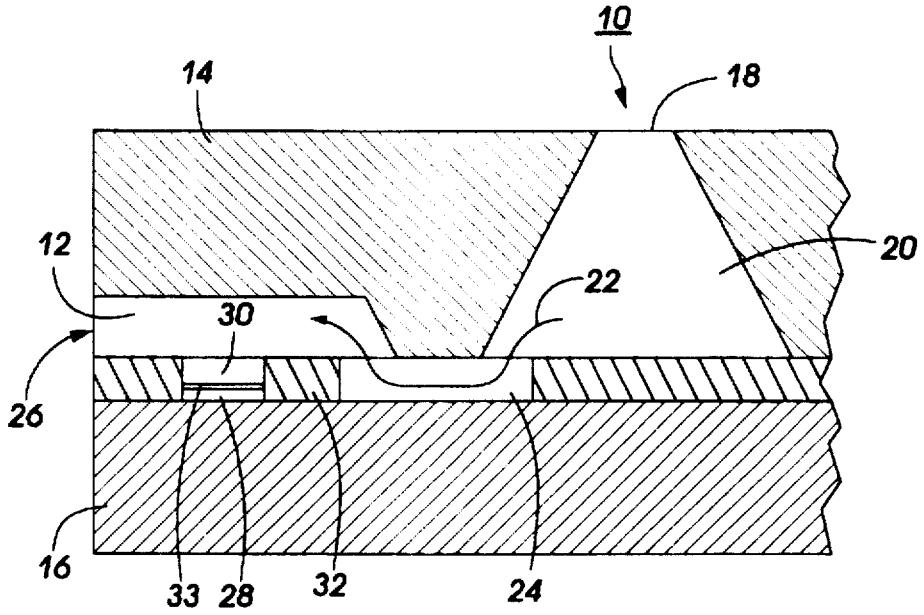
FIG. 1 is a partial cross sectional schematic side view of a thermal ink jet printhead.

FIG. 1 is a partial cross sectional schematic side view of a thermal ink jet printhead 10 of the type disclosed in U.S. Pat. No. 4,774,530 to Hawkins, incorporated herein by reference. The cross sectional view is taken along one of an array or a plurality of elongated ink carrying channels 12. The ink channel 12 is formed in an ink directing element 14 mated and aligned with a transducer element 16. The printhead 10 receives ink from a supply of ink (not shown) through an ink feed slot 18 defined in the ink directing element 14. Ink passes through the ink feed slot 18 into an ink reservoir 20 which contains an amount of ink eventually flowing therefrom in the direction of an arrow 22 through an ink pit 24, through the channel 12, and out through an ink ejecting orifice or nozzle 26. During printing, a heater or thermal transducer 28, located beneath a heater pit 30 also filled with ink, begins to vaporize the ink above the heater 28. A pit wall 32 separates the heater pit 30 from the ink pit 24. The heater, which is energized by a fire pulse signal, to be described later, heats the ink so that a bubble is nucleated therein. The vapor pressure inside the bubble is initially very high causing the bubble to expand even after the heating pulse has ended. Ink is ejected from the nozzle by this bubble expansion. After a sufficient amount of time has passed, the pressure inside the expanded bubble relaxes to a value below the atmospheric pressure. The bubble begins to collapse and the drop separates from the ink in the channel. Once the ink is ejected, ink again flows in the direction of the arrow 22 by capillary action to refill the channel 12 and the heater pit 30 for subsequent ejection of ink. The thermal transducer 28 is covered with a layer of tantalum 33 which acts as a protective layer for the heater 28.

Figure 2:
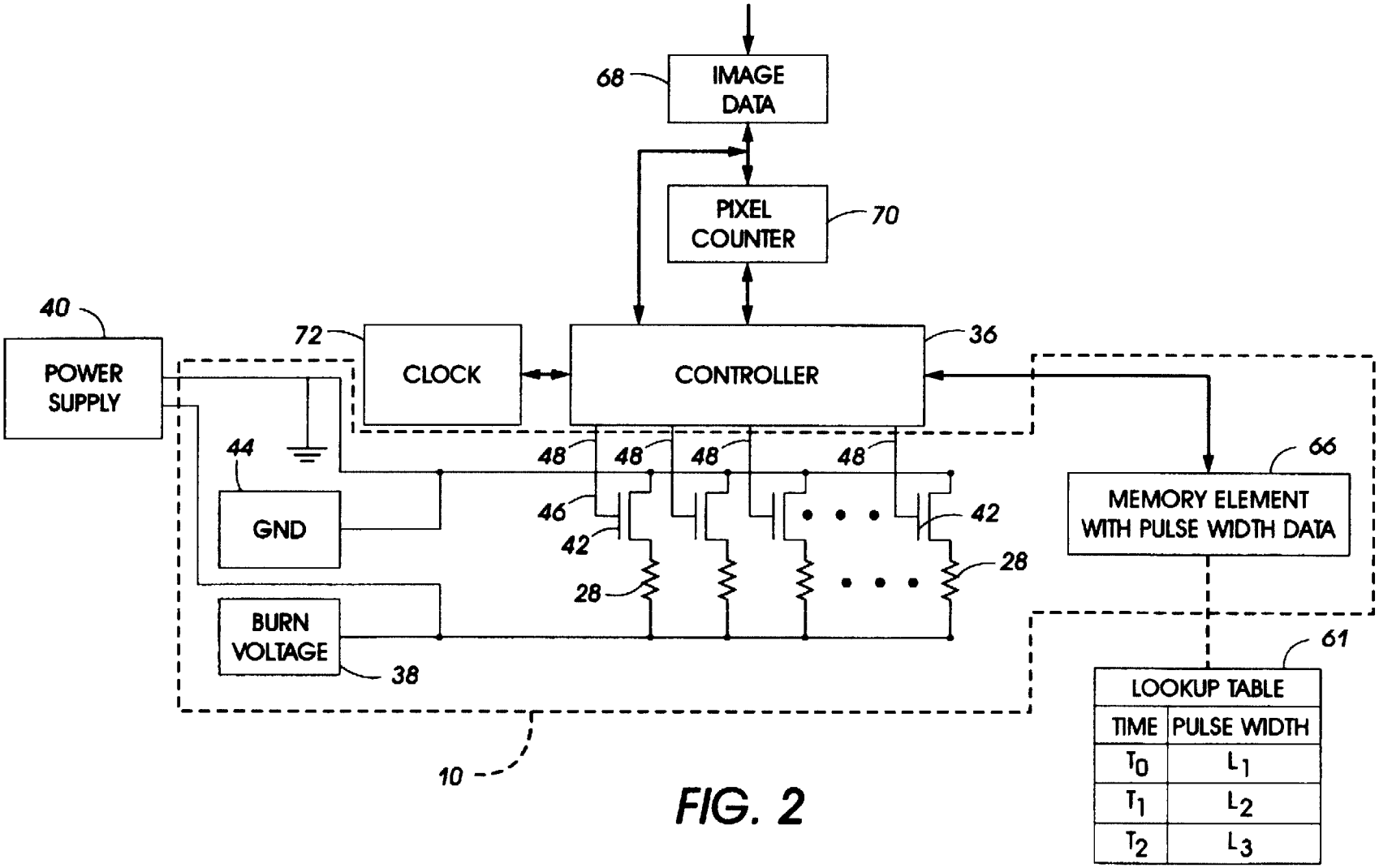
FIG. 2 is a schematic block diagram of the thermal ink jet printhead and control apparatus therefore.

FIG. 2 is a diagram illustrating a schematic block diagram of the printhead 10 and the connection thereof to a printer controller 36 controlling the operation of the printhead 10. The basic electrical elements of the printhead 10 are typically embodied on an integrated circuit which controls ink ejection from the nozzles 26. In one particular embodiment, the thermal ink jet printhead 10 includes 192 of the thermal ink jet heating elements 28. The heating elements 28 are powered by a burn voltage 38, the value of which is optimized by the present invention as described herein. The burn voltage 38 is produced by a power supply 40 coupled thereto and typically located in the printer as opposed to being resident on the printhead 10. Each of the heating elements 28 is additionally coupled to a power MOS FET driver 42 having one side thereof coupled to a common ground 44. The power MOS FET drivers 42 energize the heating elements 28 for expelling ink from the nozzles. Since a thermal ink jet printhead 10 can include any number of ink jet heating elements 28 the present invention is equally applicable to any number of ink jet heating elements 28. Four heating elements 28 are shown in FIG. 2 for illustrative purposes.

Each of the drivers 42 includes a gate 46 coupled to the controller 36. The controller 36 generates control signals, such as a firing pulse having a pulse length, which are selectively applied to the gates 46 of the drivers 42 to thereby energize the heaters 28. The controller 36 is here generically represented and includes any number of known methods and apparatus to control firing of the individual heaters 28, as is known by those skilled in the art. For instance, the controller 36 could be individually coupled to each of the gates 46, however, such a scheme can be impractical when the number of heaters necessary to be controlled increases beyond a certain number. Consequently, a bi-directional shift register is often used in controlling the application of the fire pulses carried by the control lines 48. U.S. Pat. No. 5,300,968 to Hawkins describes suitable control arrangements and is herein incorporated by reference.

As is well known in the art, the operating sequence of ejecting ink starts with the electrical firing pulse being applied to the resistive heating element in the ink filled channel. Heat is dissipated in this resistive heating element and it is conducted to the ink and to the surrounding structures. During this process the temperature of the resistive heating element, of the surrounding structures and of the ink adjacent to the transducer rises. The heat transferred to the ink must be sufficient to superheat the ink contacting the transducer to the nucleation temperature. This nucleation temperature is far above the normal boiling point of the ink: for water-based inks, this nucleation temperature is about 280° C. At the time when this temperature is reached, first small bubbles appear on the transducer surface. Additionally, the temperature of the transducer surface is not uniform during this firing pulse. The surface at the center is hotter than at the edges due to the heat conduction. Therefore, the first small bubbles appear preferentially near the center of the heater. With progression of time, these small bubbles grow and coalesce until the whole surface of the transducer is covered by one bubble. This process is very fast; compared to the firing pulse length, this process is short, appearing almost instantaneously. Yet during this time, the energy is still transferred to the remaining ink in contact with the transducer surface.

The bubble expansion is driven partly by the high vapor pressure of the originally vaporized ink and in the later stages additional vapor is supplied to the bubble by the superheated ink on the expanding liquid and vapor interface. If the firing pulse is terminated too soon after the nucleation temperature has been reached, the drop is either not ejected or it is too slow and too small. With increasing the length of the pulse, the drop velocity and drop volume reaches desired predetermined values. Increasing the pulse length further does not improve the jetting any more. When the heating continues after the transducer surface has been completely covered by the vapor bubble, the heat transfer to the ink has been substantially stopped and the temperature of the transducer surface is rising rapidly high above the nucleation temperature. It has been experimentally confirmed that the kogation is greatly accelerated by such overheating. Therefore, the optimum electrical firing pulse is such whereby the onset of bubble nucleation has been reached shortly before the end of the pulse.

The same sequence of events occurs when the amplitude of the electrical firing pulse is increased while its length is kept constant. The first indication of an approach to the threshold is the occurrence of small isolated bubbles on the surface of the transducer. At this pulse amplitude, these bubbles disappear without a drop being ejected. When the amplitude is increased, the bubbles coalesce over the transducer surface and a detectable drop is ejected. The voltage amplitude at which the drop is first detected has a well defined value and it is known in the art as the threshold voltage. With increasing pulse amplitude fast and stable drops are repeatedly produced. A typical threshold curve is schematically shown on FIG. 3.

Figure 3:
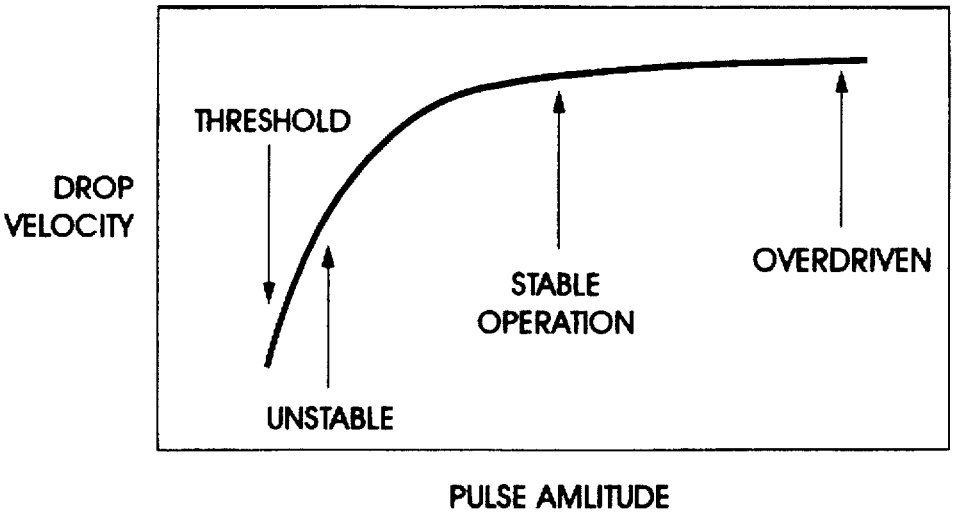
FIG. 3 is a graph illustrating drop velocity as a function of pulse amplitude.
Figure 4:
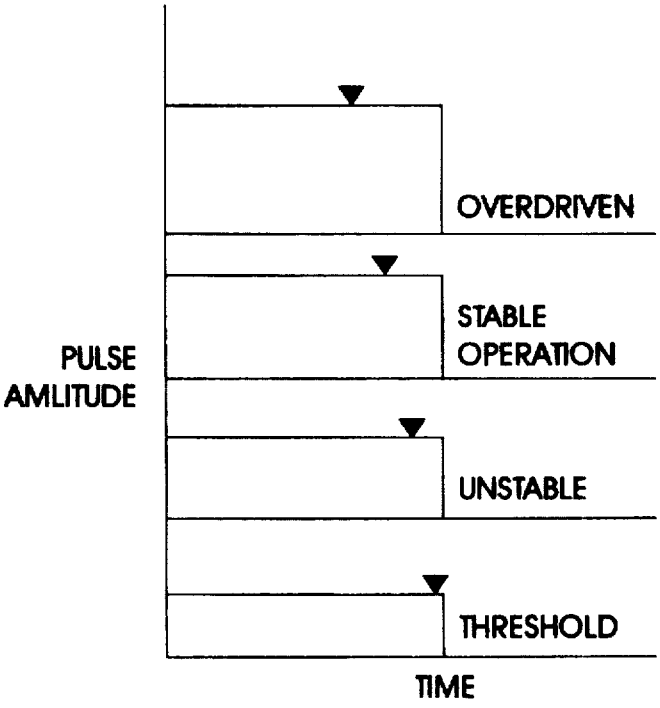
FIG. 4 is a diagram illustrating the effect of bubble nucleation with changing pulse amplitude.

As shown, increasing the pulse amplitude even further brings no additional improvement in drop velocity but does increase the energy dissipated in the printhead which leads to early overheating and increased rate of kogation. The pulsing conditions for the stages indicated in FIG. 3 are shown in FIG. 4 for firing pulses with the same pulse length but with increasing pulse amplitude. Here, the times when the bubble nucleation occurs are shown by heavy arrows.

While the optimum driving conditions can be determined for one particular transducer, these optimum conditions are impractical to be used in a printer. In such printers, the power supply used for the burn voltage to drive the printheads is generally chosen for cost reasons as an unadjustable power supply with affordable tolerance on the burn voltage. The transducers are produced in different lots over the life of the product and the manufacturing process results in variations of the electrical and thermal properties of the transducers and of their sizes. Additional sources of variability of burn voltage applied to the transducers are, for instance, the differences in voltage drops on supply circuitry when firing one transducer vs. many transducers at the same time, and a different voltage drop on the internal leads to the end transducers vs. the middle transducer. Finally, aging of the transducers over the life of the printhead generally causes the increase in the threshold voltage. From the explanation above it is clear that this effectively delays the onset of nucleation toward the end of the life of printhead if the optimum burn voltage has been chosen at the beginning of the useful life.

To accommodate these known variables, the burn voltage has, in the past, been set significantly higher than is necessary for a given transducer at favorable conditions. For instance, burn voltages are typically set at 15–25% greater than the predetermined threshold voltage. Such overvoltages in the 15–25% range, however, produce a number of undesirable consequences as already mentioned, the most serious being the sharp increase of the kogation rate which is experienced with many inks. Additionally, since the power dissipation in the printhead is higher than necessary, heat management becomes more difficult. For instance, when operating under conditions of overvoltage, the vapor bubble covers the whole surface of the transducer before the end of the heating pulse, the result being that the thermal transducer is no longer covered with ink. The transducer temperature consequently rises to unacceptable levels, such as 500° C. Even temperature rises for a few microseconds after the power is removed at the end of the heater pulse can reduce the operating life of the ink jet printhead.

While it is possible to adjust the power level by continually adjusting or controlling the burn voltage 38 throughout the life of the printhead 10, such a solution requires additional electronic hardware which can be cost prohibitive if individual transducers or banks of transducers in a printhead or page width printbar are to be controlled. The present invention, however, establishes an optimum burn voltage and compensates for the previously mentioned variabilities and operating characteristics by adjusting the length of the firing pulse. Consequently, with changes to the effective power, the actual relative overvoltage will remain acceptably constant. By maintaining the burn voltage constant throughout the life of the printhead and by only adjusting the pulse length of the firing pulse applied to each of the transducers, known problems resulting from overvoltages are effectively reduced.

Figure 5:
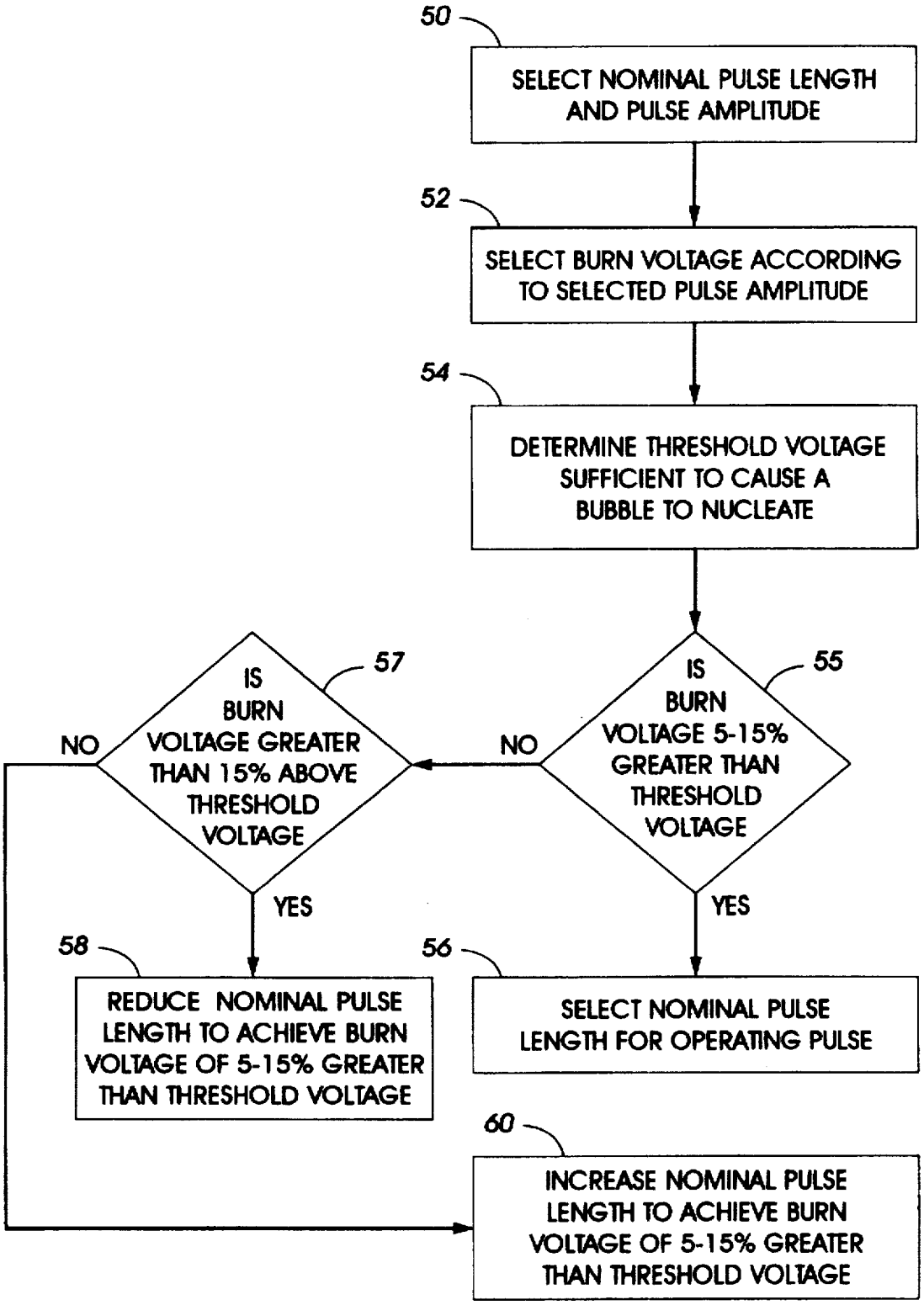
FIG. 5 is a flow chart illustrating a method of controlling the operation of a thermal ink jet printhead.

FIG. 5 illustrates a flow chart including a method to compensate for the previously mentioned variability by adjusting the length of the firing pulse so that with changes to the effective burn voltage, the actual relative overvoltage will remain acceptably constant. The general scheme is such that at step 50, the electrical pulse having a pulse length and a pulse amplitude, is selected together as a function of a transducer embodiment for a given printhead. The selected transducer has resistance and physical dimensions assuring successful printer operation at nominal values and at nominal driving conditions. A nominal burn voltage is determined at step 52 by the amplitude of the selected electrical pulse and it is provided by the power supply in the product. This selected burn voltage, however, is also subject to a variety of limitations which include the operating voltage of the power driver transistors which is typically not to exceed 50 volts, certain constraints proposed by UL laboratories safety specifications (typically around 40 volts) and other constraints.

After the nominal burn voltage has been selected, it is necessary to determine what effect the previously mentioned variabilities and changes to operating conditions over time have on the performance of the transducer. As a first step, the threshold voltage for drop generation is determined at step 54 for a given transducer or a group of transducers. This threshold voltage could be determined for individual transducers or could be an average threshold voltage for all transducers in a printhead. If the manufacturing processes for the printheads are fairly well controlled throughout all of the printheads, the threshold voltage for drop generation should be relatively constant throughout each individual printhead. It is also possible that the threshold voltage for drop generation could change from wafer to wafer, and consequently the determination of threshold voltage might be different for different lots of wafers. For instance, it has been previously noted that the phenomenon of kogation will increase the threshold voltage. Such a condition, however, is predictable and can therefore be compensated for.

In the next step, the ratio of the selected burn voltage to the actually measured threshold voltage is determined. If the burn voltage is 5–15% above the threshold voltage, the nominal pulse length is used for the operating pulse applied to the transducer at step 56.

If the burn voltage is determined to be greater, at step 57, than the threshold voltage by more than 15%, the nominal pulse length is reduced at step 58 and used as the operating pulse length so that at this new pulse length the preferable ratio of burn voltage to threshold voltage is reached. If, on the other hand, the burn voltage is no greater than 5% over the threshold voltage or if the threshold voltage is greater than the burn voltage, the nominal pulse length is increased and used as the operating pulse length at step 60. That is, if necessary, the operating pulse length is adjusted so that in the changing operating conditions, the transducers are still operated at 5–15% above the changing operation thresholds. The present pulse length control is less expensive to implement than a voltage adjustment for the burn voltage and particularly so for the application of individual voltages to different transducers which becomes prohibitively expensive.

Other factors affecting minimum threshold power are also predictable and include changes to transducer resistivity over time and changes to driver amplification. These changes can be determined either theoretically or empirically. It is possible to determine these changes by operating a number of printheads over time to determine the changes to the threshold power. A drop velocity measurement utilizing a drop sensing apparatus can be used to monitor such changes.

Figure 6:
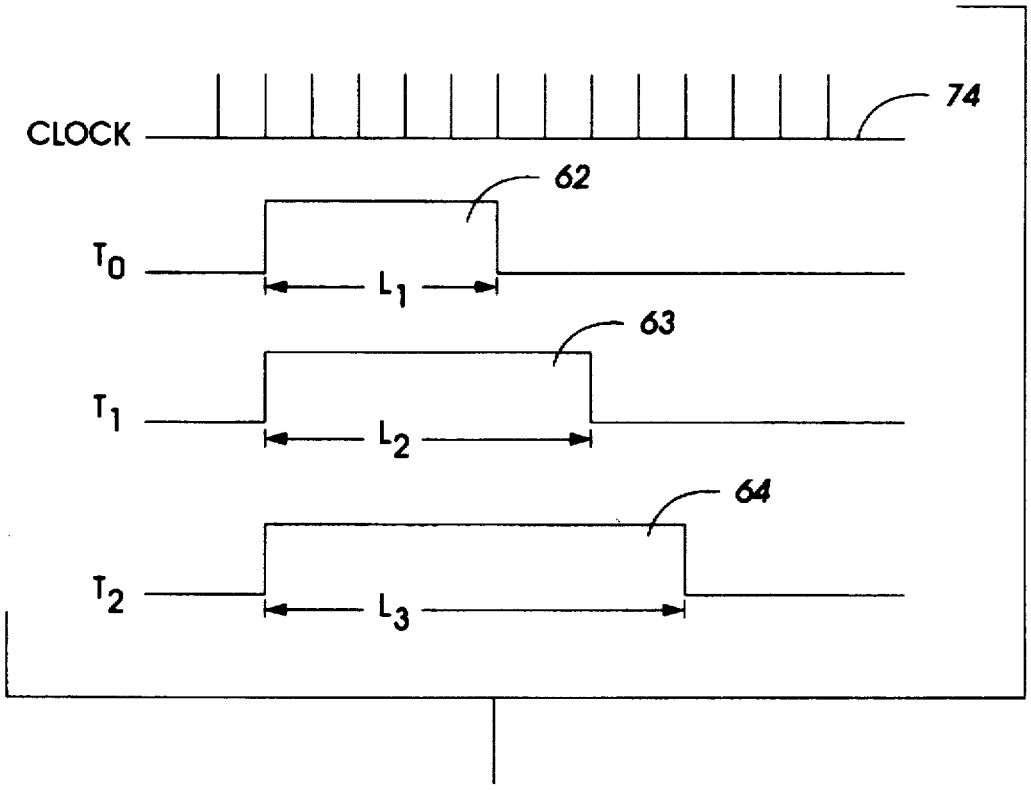
FIG. 6 is a diagram illustrating operating pulse waveforms and the changes to the operating pulse length with use to the printhead.

Once the changes to threshold power over time have been determined, a lookup table 61 (see FIG. 2) including pulse length data reflecting changes to power dissipation is created. Such a lookup table includes pulse length data wherein the pulse length increases over time to compensate for the reduced effective threshold power. For instance, as illustrated in FIG. 6, the firing pulse 62 would have a pulse length of $L_1$. The firing pulse 62 is necessary to drive the transducers at the effective operating potential at a time $T_0$ when the printhead is new and reflects the pulse length determined at one of steps 56, 58, or 60 of FIG. 5. Once the printhead has been operated for a certain period of time, determined for instance, by counting the number of drops ejected by the printhead, a pulse length $L_2$ of firing pulse 63, is adjusted to be greater than the pulse length $L_1$ for the firing pulse 62. At a still later time $T_2$, when the printhead has been operated for an additional period of time, a firing pulse 64 includes a pulse length $L_3$ which is adjusted to be greater than the pulse length $L_2$ of the firing pulse 62. The information contained in the lookup table, therefore includes not only pulse lengths of firing pulse signals but also the times at which these firing pulses should be applied during the operating lifetime of the printhead.

The lookup table, including the generated pulse length data and times of application, can then be implemented in a number of ways. For instance, as illustrated in FIG. 2, a memory element 66, including the pulse length data, can be implemented on the printhead 10, such that when the printhead 10 is mated with the controller 36 of a printer, the controller 36 can access the pulse length data present in the memory element 66 which specifically applies to the characteristics of that particular printhead. If certain manufacturing tolerances of the individual printhead element 10 are to be compensated, the printhead elements 10 can be tagged accordingly in manufacturing such that the controller 36 can effectively use the information contained within the memory element 66.

During operation, the controller 36 receives image data 68 from a personal computer or other image generating device, such as a scanner, and uses that image data 68 to control the individual firing of each of the driver transistors 42. In one embodiment of the present invention, the image data 68 is analyzed by a pixel counter 70 which counts the number of pixels being printed by the printhead 10 such that when a certain number of pixels have been counted (reflecting drops ejected), pulse length data from the memory elements 66 is updated by the controller 36. Other mechanisms for determining printhead life so that firing pulse length changes can be made appropriately include counting clock pulses or counting the number of sheets of paper or transparencies printed. A clock 72 located within the printer for providing timing features for the controller 36 and generating clock pulses 74 as illustrated in FIG. 6 provides sufficient granularity for controlling the pulse length of the firing pulses.

Similar control of power dissipation may be used to compensate for the above mentioned variability in transducers. The pulse length for a given lot of parts, resulting in the burn voltage available in the printer being the desired function of the threshold voltage is determined in the factory. This value is then encoded on the printhead by any of the means well known in the art. After the installation of the printhead in the printer, the encoded pulse length is decoded by the printer internal procedure, and the pulse length with which the printhead will be operated is determined and subsequently used for printing.

In recapitulation, there has been described an apparatus and method for controlling the transducer power dissipation in an ink jet printhead to compensate for changes to operating characteristics resulting from manufacturing and power supply tolerances and from use and the effects of aging and to reduce the effects of overvoltages. It is, therefore, apparent that there has been provided in accordance with the present invention, an ink jet printhead and method for controlling the operation thereof that fully satisfies the aims and advantages hereinbefore set forth. While this invention has been described in conjunction with a specific embodiment thereof, it is evident that many alternatives, modifications, and variations will be apparent to those skilled in the art. For instance, the present invention is not limited to applying a firing pulse having one pulse length to all the transducers within a printhead, however, but is equally applicable to applying firing pulses which may have different pulse lengths accounting for drop voltage changes throughout an array of transducers. Since voltage drops can vary depending on how many transducers are fired simultaneously, the firing pulses applied can be adjusted as necessary. Accordingly, it is intended to embrace all such alternatives, modifications and variations that fall within the spirit and broad scope of the appended claims.

What is claimed is:

1. A method of controlling the operation of an ink jet printhead including a transducer dissipating power in response to an electrical operating pulse applied thereto for nucleating an ink bubble to cause an ink droplet to be ejected from an ink ejecting orifice, comprising:

selecting a first value for a burn voltage of the electrical operating pulse;

selecting a nominal pulse length as a function of the first value of the selected burn voltage;

determining a second value for a threshold voltage of the electrical operating pulse, having the selected nominal pulse length, sufficient to cause the ink bubble to nucleate; and selecting an operating pulse length for the electrical operating pulse as a function of the second value of the determined threshold voltage by selecting the operating pulse length to be approximately equal to the selected nominal pulse length if the first value for the selected burn voltage is approximately 5–15% greater than the second value for the determined threshold voltgage.

2. A method of controlling the operation of an ink jet printhead including a transducer dissipating power in response to an electrical operating pulse applied thereto for nucleating an ink bubble to cause an ink droplet to be ejected from an ink ejecting orifice, comprising:

selecting a first value for a burn voltage of the electrical operating pulse;

selecting a nominal pulse length as a function of the first value of the selected burn voltage;

determining a second value for a threshold voltage of the electrical operating pulse, having the selected nominal pulse length, sufficient to cause the ink bubble to nucleate; and selecting an operating pulse length for the electrical operating pulse as a function of the second value of the determined threshold voltage by selecting the operating pulse length to be approximately equal to the selected nominal pulse length if the first value of the selected burn voltage is approximately 5–15% greater than the second value of the determined threshold voltage and by selecting the operating pulse length to be less than the selected nominal pulse length if the first value of the selected burn voltage is greater than approximately 15% above the second value of the determined threshold voltage.

3. The method of claim 2, wherein said third mentioned selecting step comprises selecting the operating pulse length to be greater than the selected nominal pulse length if the first value of the selected burn voltage is less than approximately 5% above the second value of the determined threshold voltage.

4. The method of claim 3, wherein said third mentioned selecting step comprises selecting the operating pulse length to be greater than the selected nominal pulse length if the second value of the determined threshold voltage is greater than the first value of the selected burn voltage.

5. The method of claim 4, comprising determining an adjustment to the length of the operating pulse length necessary to accommodate changes to the second value of the determined threshold voltage resulting from operation of the printhead.

6. The method of claim 5, comprising generating a look-up table including operating pulse length data as a function of changes to the second value of the determined threshold voltage resulting from operation of the printhead.

7. The method of claim 6, comprising incorporating the lookup table into a memory device resident on the ink jet printhead.

8. The method of claim 7, comprising retrieving the data in the lookup table at specified times related to changes to the second value of the determined threshold voltage resulting from operation of the printhead.

9. The method of claim 8, comprising applying the selected burn voltage to the transducer.

10. The method of claim 9, comprising applying the selected operating pulse length for the operating pulse to the transducer to eject an ink droplet from the ink ejecting orifice.

11. The method of claim 10, further comprising controlling the operation of an ink jet printhead including a plurality of transducers.

12. The method of claim 11, wherein said first mentioned selecting step comprises determining an average burn voltage for the operating pulse applied to the plurality of transducers.

13. The method of claim 12, wherein said determining step comprises determining an average threshold voltage for the plurality of transducers.

* * * * *